United States Patent [19]

Kiriake

[11] Patent Number: 4,566,644

[45] Date of Patent: Jan. 28, 1986

[54] SYSTEM FOR SUPPLYING VARIQUS KINDS OF COPS TO WINDER

[75] Inventor: Masaharu Kiriake, Kyoto, Japan

[73] Assignee: Murata Kikai Kabushiki Kaisha, Kyoto, Japan

[21] Appl. No.: 543,780

[22] Filed: Oct. 20, 1983

[30] Foreign Application Priority Data

Oct. 26, 1982 [JP] Japan ..... 57-188459

[51] Int. Cl.[4] ..... B65H 54/20; B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 3,195,298 | 7/1965 | Furst | 242/35.5 A X |
| 3,358,940 | 12/1967 | Beckwith, Jr. et al. | 242/35.5 A X |
| 3,474,975 | 10/1969 | Brouwer et al. | 242/35.5 R |
| 3,563,479 | 2/1971 | Brouwer et al. | 242/35.5 A |
| 3,774,859 | 11/1973 | Brouwer et al. | 242/35.5 R |
| 3,998,397 | 12/1976 | Haberkorn et al. | 242/35.5 A |
| 4,010,907 | 3/1977 | Nishiyama et al. | 242/35.5 A |
| 4,181,228 | 1/1980 | Hashimoto et al. | 242/35.5 R |
| 4,212,433 | 7/1980 | Matsui et al. | 242/35.5 A |
| 4,463,909 | 8/1984 | Kiriake et al. | 242/35.5 A |

*Primary Examiner*—Stanley N. Gilreath

*Attorney, Agent, or Firm*—Spensley Horn Jubas & Lubitz

[57] ABSTRACT

A system for transporting and supplying different kinds of cops to an automatic winder. The system includes a cop feeding passages disposed on one side of the winding units of the winder, a bobbin ejecting passage disposed on the other side of the winding units and dividing devices provided in the cop feeding passage and bobbin ejecting passage which can divide the passages at any desired positions in the direction along the unit so that the automatic winder can be divided into a plurality of sections.

20 Claims, 8 Drawing Figures

SYSTEM FOR SUPPLYING VARIOUS KINDS OF COPS TO WINDER

BACKGROUND OF THE INVENTION

The present invention relates to a system for supplying cops to an automatic winder and more particularly to a system for transporting and supplying different kinds of cops, which are specifically different in yarn count from each other.

The cop, which is formed by winding up on a bobbin a spun yarn produced by a spinning frame, particularly a ring spinning frame, is generally rewound on a package having a size and shape suitable for the subsequent process for removing a possible yarn defective portion or the process carried out by means of a weaving machine, knitting machine or the like.

An automatic winder employed in the rewinding process is constituted by a multiplicity of winding units each constituted by a spindle. The yarn drawn out from a full cop supplied to each unit is wound up on a package rotated at a high speed by a driving drum. When all the yarn on one bobbin has been wound up on the package, the subsequent cop is newly supplied, and the end of yarn on the package side and the end of yarn on the bobbin side are knotted to continue the winding up, thereby one full-wound package is formed from the yarns from a plurality of full cops.

In such an automatic winder, a single winder usually winds up one kind of yarn. In this case, therefore, only one kind of cop is supplied, and cops can be supplied at random without the need for arranging any relationship between the wind-up units and the cops to be supplied thereto. However, when a multiplicity of kinds of yarn are wound up by a single winder, specific yarns must be supplied to specific winding units, respectively, without mixing up the supplied cops.

Moreover, it is necessary to permit the output to be easily regulated according to need.

In this case, if winders in number corresponding to the number of kinds of yarn are prepared, for example, two winders each having 60 spindles are prepared for winding up two kinds of yarn, and if the yarn of a kind A is wound up by one winder, while the yarn of a kind B is wound up by the other winder, exclusively, the following problem is encountered: If the winder for the yarn of the kind A is run with all the 60 spindles operated in order to increase the output, while the winder for the yarn of the kind B is run with only 40 spindles operated in order to hold down the output, 20 spindles, i.e., 20 winding units are in the inoperative state, resulting in an operation loss.

SUMMARY OF THE INVENTION

The present invention relates to a system for transporting and supplying different kinds of cops to an automatic winder.

An object of the present invention is to permit a single winder to wind up a multiplicity of kinds of yarn as well as make it possible to regulate the output for each kind of yarn.

According to the invention, on one side of the winding units of the automatic winder having a multiplicity of winding units provided in parallel, a cop feeding passage is disposed which extends along the whole units, while on the other side of the winding units a bobbin ejecting passage is disposed which extends along the whole units. In addition, both the cop feeding passage and the bobbin ejecting passage are provided with the dividing guides which can divide the passages at any desired positions in the direction along the units so that the automatic winder can be divided into a plurality of sections at will. Therefore, the multiplicity of winding units constituting the automatic winder can be divided into wind-up sections each having any desired number of units. Accordingly, in changing the numbers of the winding units for winding up different kinds of yarn, the winding unit numbers can be easily changed simply by changing the positions of the dividing guides, so that it is possible to readily regulate the wind-up amounts of different kinds of yarn. Therefore, the output can be regulated according to the need for yarn by an extremely simple operation.

DETAILED DESCRIPTION OF THE INVENTION

An embodiment of the invention will be described hereinunder with reference to the accompanying drawings.

Figure 1:
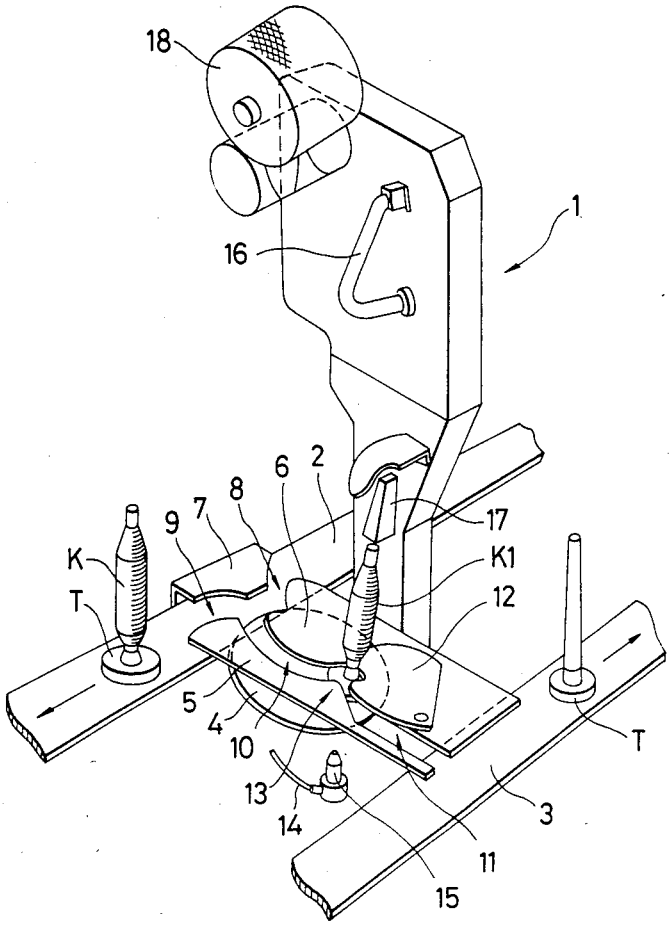
FIG. 1 is a perspective view of an example of a winding unit applied to the system in accordance with the invention.

FIG. 1 shows a winding unit and a system for supplying cops to the unit.

The winding unit 1 is disposed between a cop feeding passage 2 and a bobbin ejecting passage 3. A cop is taken in from the feeding passage 2 by means of a rotary disc 4 and guide plates 5, 6, 7.

It is to be noted that, in this system, a cop K is independently transported while being kept upright by an independent transport medium (referred to as "carrier T", hereinafter). The cop is supplied to the winding unit and wound up thereby while remaining fitted on the carrier T. The empty bobbin is also ejected and transported along the ejecting passage 3 while remaining fitted on the carrier.

The rotary disc 4 is rotated through a part thereof brought into contact with a conveyor belt constituting the feeding passage 2. The rotary disc 4 is so arranged that the side thereof closer to the cop feeding passage 2 is higher than the side thereof closer to the ejecting passage 3.

Above the rotary disc 4, the guide plates 5, 6 are secured with a predetermined gap left between the same and the upper surface of the rotary disc 4. An inlet 8 is defined by the guide plates 6, 7, and a surplus cop outlet 9 is defined by the guide plates 5, 7. In addition, a cop stand-by line 10 and a bobbin eject line 11 are defined between the guide plates 5, 6. Moreover, a reference numeral 12 denotes a swiveling lever for discharging a bobbin at a yarn running position of a winding unit.

An air nozzle 15 connected to a duct 14 communicating with a compressed air supply source is provided under the carrier T at the yarn running position 13, i.e., below the rotary disc 4. The air jetted out from the nozzle 15 is applied into the space in the peg of the carrier T through a slit (not shown) formed in the rotary disc 4 and is moreover applied into a central bore formed in the bobbin through a bore formed at the upper end of the peg to blow upward the end of the yarn hanging inside the central bore of the bobbin. The yarn end blown upwardly is sucked and held by a relay pipe 16 standing by above the yarn end.

Above the cop K1 at the yarn running position 13, there are provided a balloon breaker 17, the relay pipe 16 for guiding the end of the yarn on the side of the cop to a knotter, not shown, a suction mouth for guiding the end of the yarn on the side of a package 18 to the knotter, a slub catcher for detecting a defect of the yarn and so forth.

Figure 2:
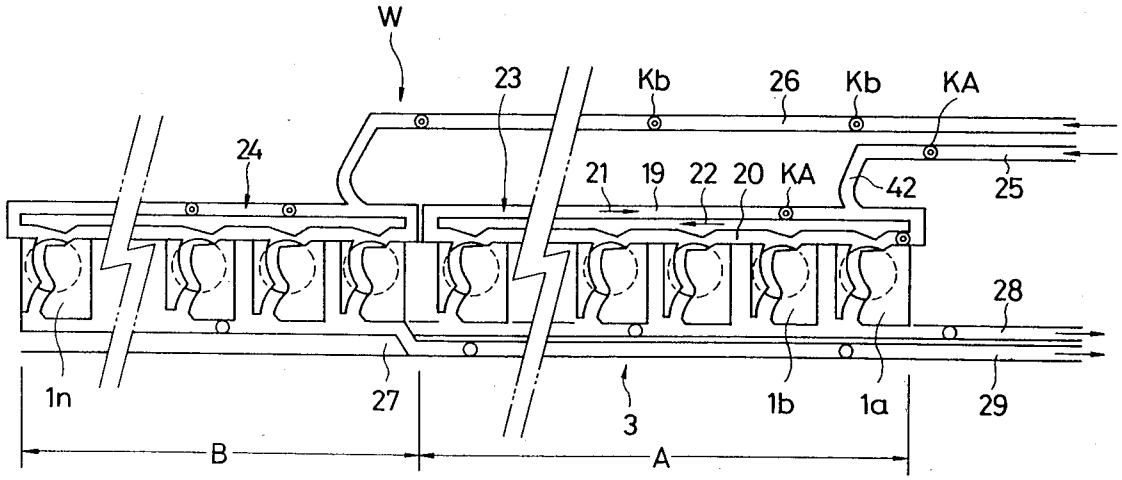
FIG. 2 is a plan view showing the layout of a cop feeding passage and a bobbin ejecting passage.

FIG. 2 shows the cop feeding passage for supplying cops to an automatic winder W having a multiplicity of the above winding units disposed in parallel, and the bobbin ejecting passage for discharging bobbins therefrom.

On one side of the winding units 1*a*, to 1*n*, two conveyor belts 19, 20 are laid along the whole units. One conveyor belt 19 runs in the direction of an arrow 21, while the other conveyor belt 20 runs in the opposite direction, shown by an arrow 22. The conveyor belts 19, 20 and a dividing guide in combination form cop supply passages 23, 24, which are closed loops, respectively, so that a single winder is divided into a plurality of sections A, B. The section A is supplied with only cops Ka transported through a carry-in passage 25, while the section B is supplied with only cops Kb transported through a carry-in passage 26, different from the carry-in passage 25; therefore, both cops will never mix up with each other.

On the other side of the winder, a single wide conveyor belt 27 is laid along the whole units, and is partitioned by a guide/partition plate into bobbin ejecting passages 28, 29 for the respective sections' exclusive use.

Figure 3:
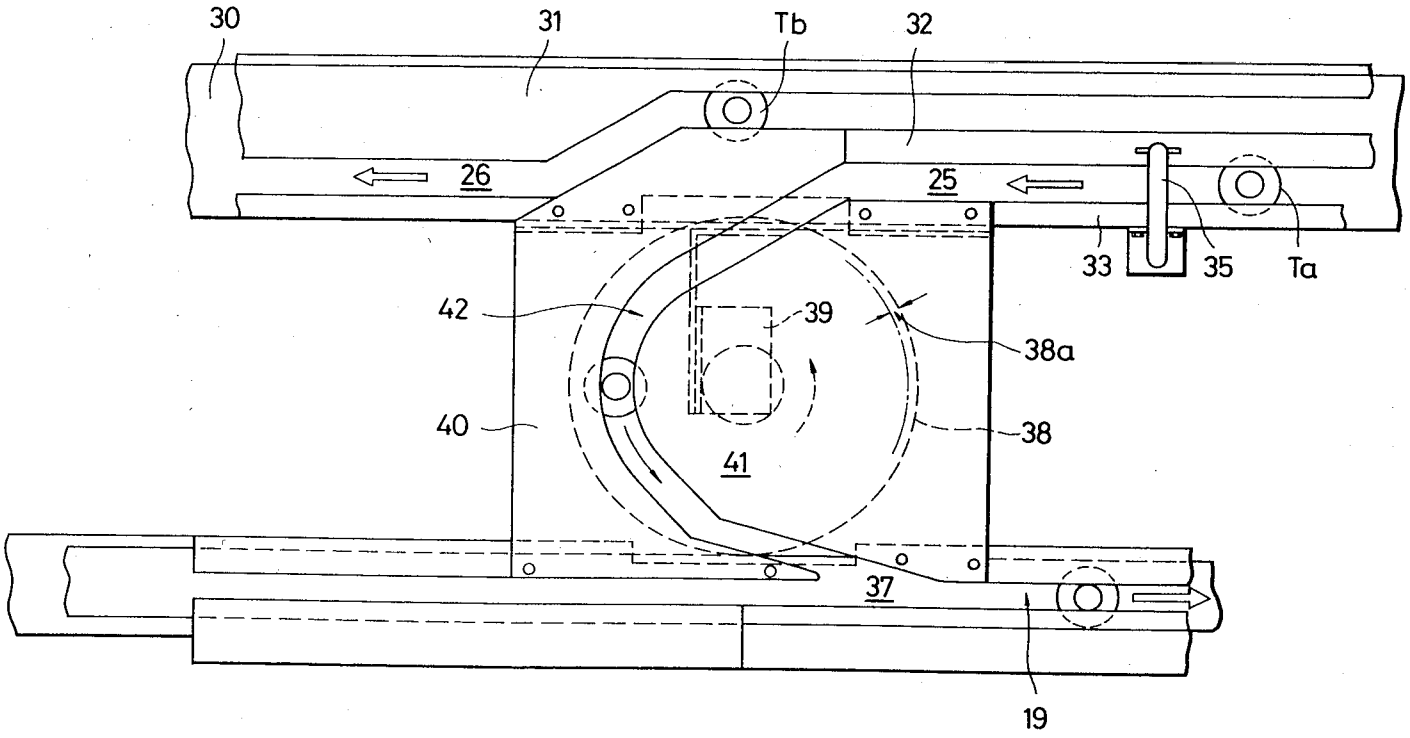
FIG. 3 is a plan view showing the connecting portion between a cop supplying passage and the cop feeding passage.
Figure 4:
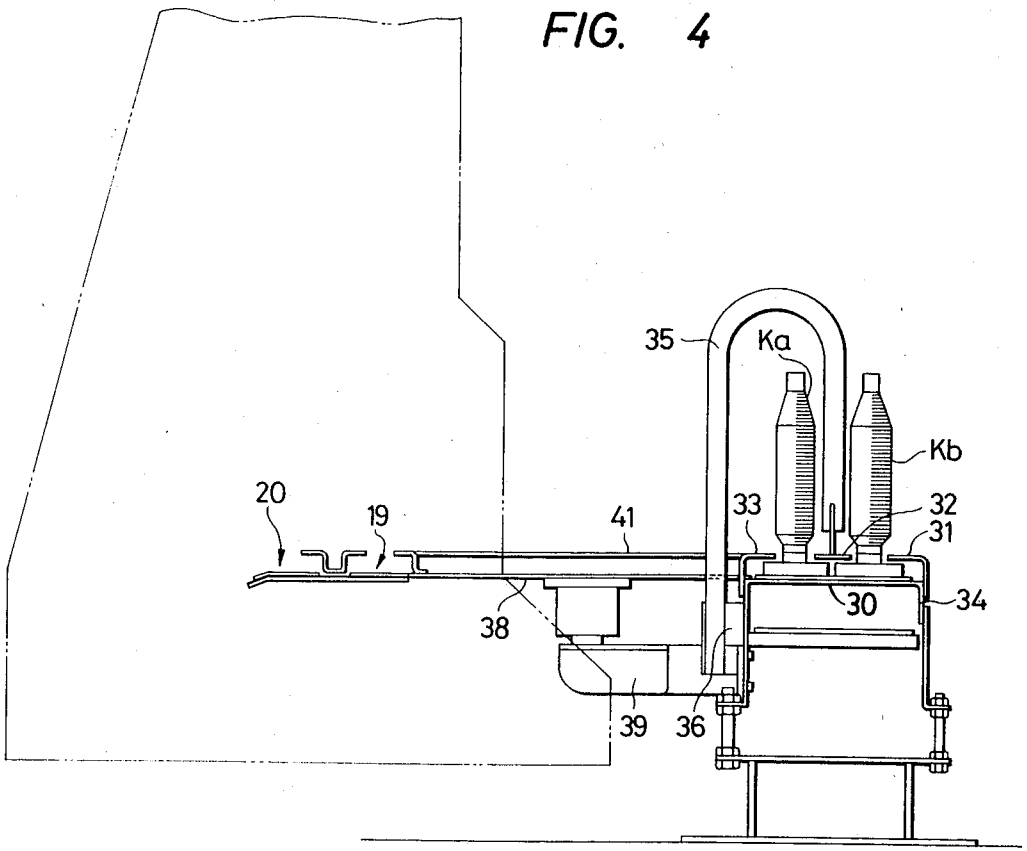
FIG. 4 is a side elevational view of the connecting portion shown in FIG. 3.

The connecting portion between the cop carry-in passage 25 and the cop supply passage 23 in FIG. 2 is shown in FIGS. 3 and 4. More specifically, the carry-in passage 25 is constituted by a single wide conveyor belt 30 and guide plates 31, 32, 33 for transporting cops on the belt while separating them according to kinds. The belt 30 and the guide plates 31, 32, 33 are secured to a frame 36 through a frame 34 and a suspending arm 35.

Between the carry-in passage 25 on the conveyor belt 30 and a passage 37 on the cop supply passage side, a rotary disc 38 is rotatably supported by a bracket 39. The disc 38 and guide plates 40, 41 in combination define a semicircular carrier passage 42. The rotary disc 38 has an annular portion 38*a* on the outer periphery thereof which is brought into contact with the side of the conveyor belt 30 closer to the carry-in passage so as to be rotated by the running force of the belt 30. Accordingly, a carrier Ta fitted with a cop which is transported along the carry-in passage 25 is mounted onto the rotary disc 38 and transferred to the supply passage on the conveyor belt 19 through the passage 42.

Figure 5:
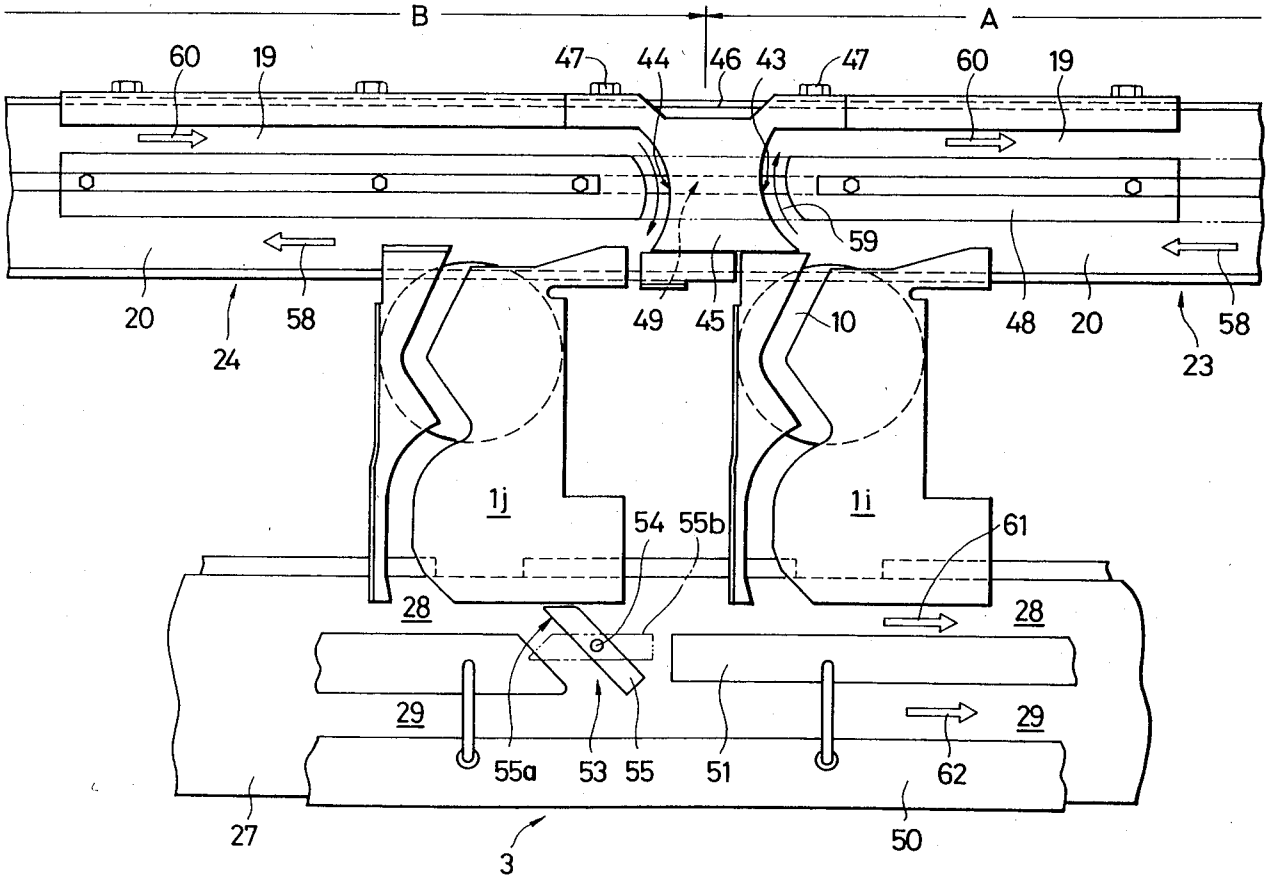
FIG. 5 is a plan view of an embodiment of the system in accordance with the invention.

The following is the description of the mechanism constituting the closed loop defining the bobbin yarn supply passage 23 along the units. More specifically, the closed loop dividing mechanism provided between the wind-up sections A, B in FIG. 2 is formed, as shown in FIG. 5, by detachably securing to a frame 46 by screws 47 a dividing guide 45 constituted by a partition plate having a first guide face 43 and a second guide face 44 which is provided at the boundary portion between the wind-up sections A, B. The first guide face 43, which is for transferring carriers on the conveyor belt 20 to the conveyor belt 19, defines a closed loop supply passage on the side of the section A. On the other hand, the second guide face 44, which is for transferring carriers on the conveyor belt 19 to the conveyor belt 20, defines a closed loop supply passage on the side of the section B. It is to be noted that a notch 49 is previously formed in a guide plate 48 between the conveyor belts 19, 20 at the boundary portion between the sections A, B. The partition plate 45 is disposed at the notch 49. Accordingly, if such notches 49 are provided at a plurality of positions on the winder, the numbers of units constituting wind-up sections, respectively, can be increased or decreased at will by securing the partition plates 45 into the notches at proper positions.

It is to be noted that the eject passages on the side of the bobbin ejecting passage 3 are also changed over in accordance with the section dividing form on the side of the cop supply passages 23, 24. More specifically, as shown in FIG. 5, on the single conveyor belt 27 laid along the whole winding units 1, guide plates 50, 51, 52 are provided over the entire length of the belt 27 along the running direction thereof to form carrier ejecting passages 28, 29 separate from each other, thereby constituting bobbin ejecting passages.

A notch 53 is formed in the guide plate 51 extending between the passages 28, 29 for each unit or each span. At each notch, a changeover guide 55 is provided which is rotatable about a shaft 54 so as to be properly positioned. Thus, the changeover guide 55 can advance into and retract from the passage 28 at will. When the changeover guide 55 is in the solid-line position, the carrier transported on the passage 28 is prevented from further advancing on the passage 28 by a guide surface 55*a* and therefore is shifted to the other passage 29 and transported thereon. On the other hand, when the changeover guide 55 is positioned in the two-dot chain line position 55*b*, i.e., on the same straight line as the guide plate 51, the carrier transported on the passage 28 passes the changeover guide position 55*b* and is transported on the passage 28 without being shifted. Thus, also on the ejecting passage 3, carriers discharged from the winding units according to the kinds of cops can be transported on the passages for their exclusive use, respectively.

Figure 6:
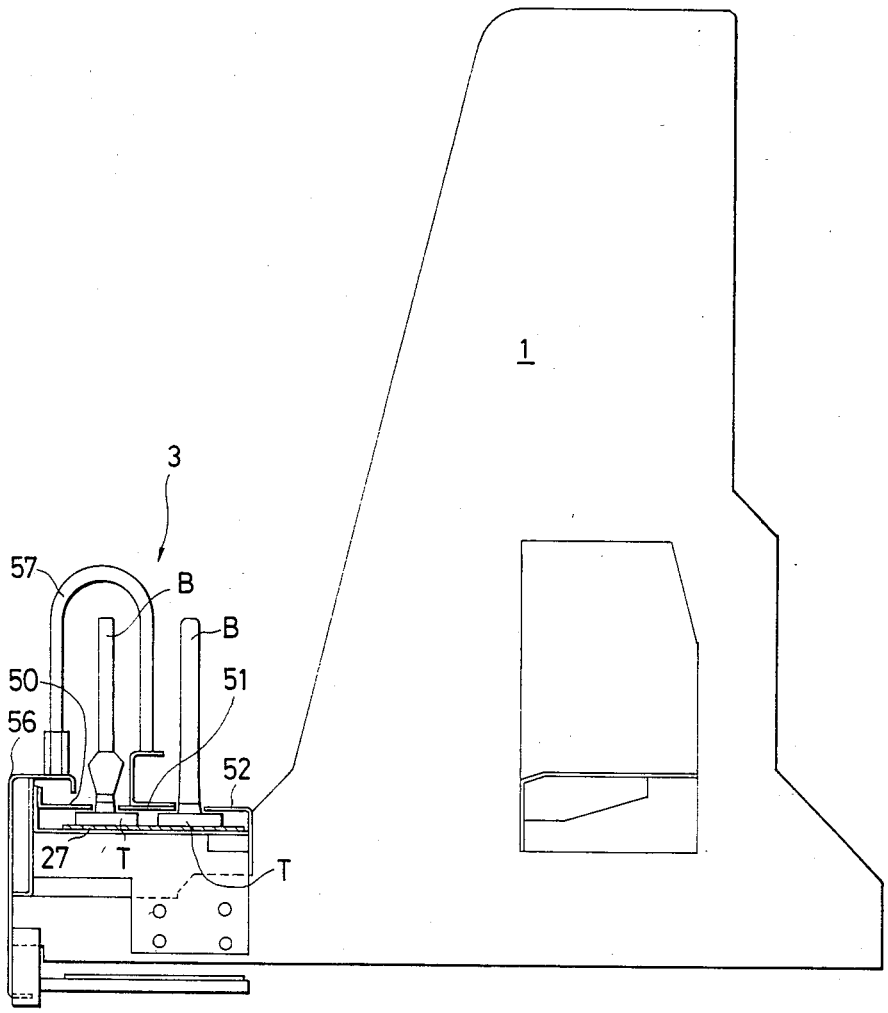
FIG. 6 is a side elevational view of the bobbin ejecting passage.

It is to be noted that the conveyor belt 27 constituting the ejecting passage 3 is a single wide belt; therefore, the central guide plate 51 is suspended from a curved arm 57 supported on a fixed frame 56 as shown in FIG. 6, the arm 57 being curved at a position higher than at least the height of bobbins B fitted in the respective carriers T.

Accordingly, in FIG. 5, if the wind-up section is divided at the boundary portion between the winding units 1*i*, 1*j* to wind up different kinds of yarn in the sections A, B, respectively, the cops on the respective carriers transported on the passage on the conveyor belt 20 in the section A in the direction of an arrow 58 are supplied to the stand-by lines 10 of the respective units. When a predetermined number of cops have been supplied into the stand-by line 10 of the end unit 1*i*, the subsequent cop are shifted by the guide plate 45 in the direction of an arrow 59 and transported on the passage on the conveyor belt 19 in the direction of an arrow 60 and then are transferred onto the passage on the conveyor belt 20 again at the other end portion to recirculate through the closed loop.

On the other hand, the empty bobbins which have no yarn or bobbins with residual yarn discharged from the winding unit 1*i* are transported on the passage 28 in the direction of an arrow 61 together with the empty bobbins or other bobbins ejected from the units along the passage 28.

Also in the section B, the cops which are recirculating through the passages on conveyor belts 19, 20 on the side of the cop supply passage 24 in the directions of the arrows 58, 60, respectively, are successively supplied to the winding units, and the empty bobbins or other bobbins ejected from the respective units are transported on the passage 28 on the side of the ejecting passage 3. When the changeover guide 55 is positioned and fixed in the solid-line position, these bobbins are shifted from the passage 28 to the passage 29 and transported on the passage 29 in the direction of an arrow 62.

Figure 7:
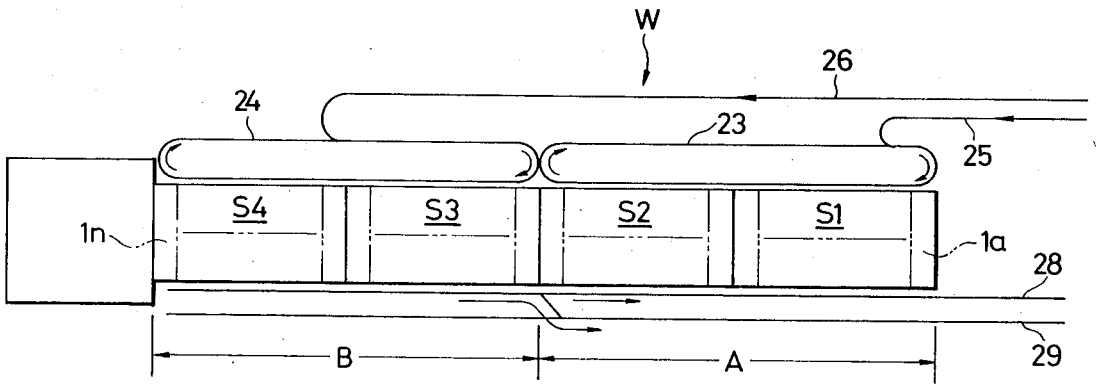
FIGS. 7 and 8 in combination illustrate schematically the cop supply method by the system in accordance with the invention.
Figure 8:
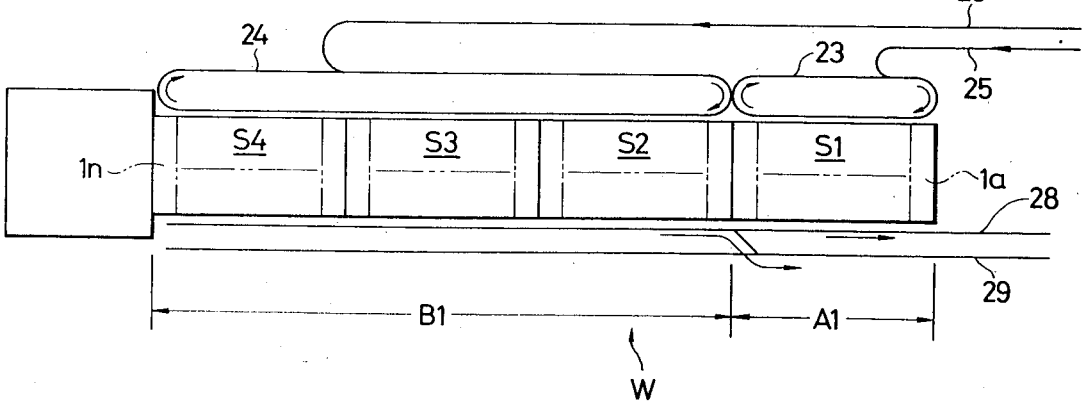

Accordingly, if the numbers of winding units constituting the wind-up sections A, B, respectively, are desired to be changed, e.g., if it is desired to change the formation of the sections A, B which are now constituted by spans S1, S2 and spans S3, S4, respectively, as shown in FIG. 7, into a formation in which the section B is to be constituted by the spans S2, S3, the partition plate 45 shown in FIG. 5 secured between the spans S2 and S3 shown in FIG. 7 is removed and secured between the spans S1 and S2 by means of screws, and the changeover guide 55 between the spans S2 and S3 is returned to the two-dot chain-line position 55*a* shown in FIG. 5, while the changeover guide 55 between the spans S1 and S2 is rotated so as to be positioned in the solid-line position shown in FIG. 5, thereby a cop supply passage as shown in FIG. 8 is formed.

Thus, it is possible to change the number of winding units for winding up one kind of yarn. More specifically, assuming that the automatic winder W has 60 spindles, i.e., 15 spindles for each of the spans S1, S2, S3, S4 shown in FIGS. 7 and 8, each of the sections A, B shown in FIG. 7 has 30 spindles, while the sections A1 and B1 shown in FIG. 8 have 15 spindles and 45 spindles, respectively. Accordingly, it is possible to increase the output of the packages in the section B1 and decrease the output of the packages in the section A1.

It is to be noted that although, in the above embodiment, the number of winding units is regulated in the unit of span, it is not exclusive and the regulation may be effected for each winding unit. In such case, it is only necessary to provide the dividing guide 45 at each spindle position as well as form the notch 49 for attaching the guide plate 48 at each spindle position and arrange such that the notches 49 at the unit positions other than the section changeover portions are closed by slide members.

Moreover, the winding unit number regulation can be similarly effected in a combination of two automatic winders connected together.

Furthermore, the wind-up sections A, B, A1, B1, can be further divided into smaller wind-up sections between the extreme right winding unit, 1*a*, and the extreme left winding unit, 1*n*, if a rotary disk 38, like that shown in FIG. 3 for connecting the cop carry-in passages 25, 26 with the cop supply passage on conveyor belt 19, is provided for each of the smaller wind-up sections.

In addition, the cop carry-in passages 25, 26 can be directly connected to a spinning frame for manufacturing the yarn for each wind-up section or can be made continuous with a parts feeder which stores cops from the spinning frame.

It is to be noted although the invention has been described through the embodiment in which the automatic winder is divided into two sections, the number of the sections can be increased to three or more.

What is claimed is:

1. A system for supplying various kinds of cops to a winder, said system comprising:

an automatic winder having a multiplicity of winding units;

a cop feeding means for conveying cops to said multiplicity of winding units, said cop feeding means defining a cop feeding passage and being disposed on one side of said winding units while extending along said winding units;

a bobbin ejecting means for conveying unwound bobbins away from said winding units, said bobbin ejecting means defining a bobbin ejecting passage and being disposed on the other side of said winding units while extending along said winding units; and dividing devices provided in said cop feeding passage and said bobbin ejecting passage, said dividing devices dividing said cop feeding passage and said bobbin ejecting passage into at least two passages at any desired positions along said winding units to permit the cop feeding means and bobbin ejecting means to convey cops to and from different wind-up sections comprised of one or more winding units, thereby making it possible to change the numbers of said winding units in each wind-up section.

2. A system as claimed in claim 1, wherein said cop feeding means comprises a first and a second adjacent conveyor belts which run along the winding units to supply cops to said winding units, said first belt running in the opposite direction from said second belt and wherein the first and second conveyor belts and the dividing device provided in said cop feeding passage form cop supply passages on opposite sides of said dividing device provided in said cop feeding passage.

3. A system as claimed in claim 2, further comprising carry-in means for supplying each of said cop supply passages with a selected kind of cop, said carry-in means defining a plurality of carry-in passages, wherein each carry-in passage is associated with a cop supply passage and directs a selected kind of cop to the associated cop supply passage.

4. A system as claimed in claim 3, wherein said carry-in means comprises a third conveyor belt for conveying the cops to the cop supply passages and a plurality of first opposing guide surfaces, defining said carry-in passages therebetween, adjacent to said third conveyor belt.

5. A system as claimed in claim 4, further comprising:

a rotatable disk, disposed between each carry-in passage and each cop supply passage, for conveying cops on the planar surface of the disk from each carry-in passage to the associated cop supply passage, the periphery of the rotatable disk contacting the third conveyor belt so that the translation of the third conveyor belt rotates the rotatable disk; and a substantially semicircular carrier passage adjacent to the planar surface of the rotatable disk for directing cops along the planar surface of the rotatable disk from the carry-in passage to the associated cop supply passage, the carrier passage being defined by a first convex guide surface and a second concave guide surface confronting the first convex guide surface.

6. A system as claimed in any of claims 2, 3, 4, and 5, wherein each dividing device provided in said cop feeding passage comprises a first and a second oppositely directed concave guide surfaces removably positionable across the first and the second conveyor belts so that the first guide surface diverts cops from the first conveyor belt to an adjacent position on the second conveyor belt and so that the second guide surface diverts cops from the second conveyor belt to an adjacent position on the first conveyor belt.

7. A system as claimed in claim 1, wherein said bobbin ejecting means comprises a fourth conveyor belt for conveying unwound bobbins away from said winding units and a plurality of second opposing guide surfaces, adjacent to said fourth conveyor belt, defining therebetween first and second bobbin ejecting passages for guiding the cops on the fourth conveyor belt away from the winding units.

8. A system as claimed in claim 7, wherein each dividing device provided in said bobbin ejecting passage comprises a member disposed between the first and the second bobbin ejecting passages, the member being rotatable between a first position wherein the member angularly projects into the first bobbin ejecting passage so that cops travelling in the first bobbin ejecting passage contact the member and are directed into the second bobbin ejecting passage and a second position wherein the member is flush with one of said second opposing guide surfaces.

9. A system for supplying various kinds of cops, which are wound on bobbins, to a plurality of winding units, the system comprising:

a first conveyor means for conveying cops to a plurality of winding units, said first conveyor means defining a cop feeding passage for directing the cops to the winding units; and divider means, removably locatable at a plurality of locations along the cop feeding passage for dividing the cop feeding passage into a plurality of cop supply passages, each cop supply passage supplying cops to selected winding units.

10. A system as claimed in claim 9, further comprising a plurality of cop carry-in means for supplying selected kinds of cops to each cop supply passage.

11. A system as claimed in claim 9, further comprising a second conveyor means for conveying unwound bobbins away from said winding units, said second conveyor means defining a first bobbin ejecting passage for receiving unwound bobbins from the winding units and a second bobbin ejecting passage for receiving selected unwound bobbins from said first bobbin ejecting passage.

12. A system as claimed in claim 11, further comprising diverter means for diverting the unwound bobbins at a selected location along the first bobbin ejecting passage from the first to the second bobbin ejecting passage, wherein said selected location is selected to divert bobbins from predetermined winding units into the second bobbin ejecting passage.

13. A system for supplying various kinds of cops, which are wound on bobbins, to a plurality of winding units and for transporting the unwound bobbins associated with each kind of cop away from the winding units, the system comprising:

a plurality of cop supply passages for conveying the different kinds of cops to the winding units, the cop supply passages comprising:

(i) a first conveyor means for conveying cops in a first direction to the winding units;

(ii) a second conveyor means disposed adjacent to the first conveyor means for conveying cops in the opposite direction from the cops conveyed by the first conveyor means; and (iii) at least one first diverting means for diverting cops being conveyed by the first conveyor means to an adjacent location on the second conveyor means and for diverting cops being conveyed by the second conveyor means to an adjacent location on the first conveyor means, wherein the first diverting means is movably locatable to a plurality of locations along the first and the second adjacent conveyor means to thereby vary the length of the cop supply passages conveying different kinds of cops on each side of the first diverting means;

a plurality of bobbin ejecting passages for conveying unwound bobbins away from the winding units, the bobbin ejecting passages comprising:

(i) a first bobbin ejecting passage being defined by a first guide surface and a second guide surface confronting the first guide surface;

(ii) a second bobbin ejecting passage being defined by a third guide surface and a fourth guide surface confronting the third guide surface;

(iii) at least one third conveyor means for conveying the bobbins away from the winding units between the first and the second guide surfaces and between the third and the fourth guide surfaces; and (iv) at least one second diverting means for diverting the bobbins from the first bobbin ejecting passage to the second bobbin ejecting passage to maintain the bobbins associated with each kind of cop in separate bobbin ejecting passages.

14. A system as claimed in claim 13, wherein a plurality of first diverting means are disposed at intervals along the first and the second adjacent conveyor means so that different kinds of cops circulate on the first and second conveyor means between adjacent first diverting means.

15. A system as claimed in claim 13, further comprising:

a plurality of carry-in passages, each carry-in passage being defined by a pair of opposed carry-in guide surfaces for guiding the cops from each carry-in passage into an associated cop supply passage; and at least one fourth conveyor means for conveying cops toward the cop feeding passages between each pair of opposed carry-in guide surfaces.

16. A system as claimed in claim 15, wherein the fourth conveyor means comprises a single conveyor belt spanning the plurality of carry-in passages.

17. A system as claimed in claim 16, further comprising:

a rotatable disk disposed between the second conveyor means and the fourth conveyor means for conveying cops from each carry-in passage to the associated cop supply passage, the periphery of the rotatable disk contacting the conveyor belt comprising the fourth conveyor means so that the translation of the conveyor belt rotates the rotatable disk; and a substantially semicircular carrier passage adjacent to the planar surface of the rotatable disk for directing cops along the planar surface of the rotatable disk from the carry-in passage to the associated cop supply passage, the carrier passage being defined by a first convex guide surface and a second concave guide surface confronting the first convex guide surface.

18. A system as claimed in any of claims 13 to 17 wherein the first diverting means comprises a member having a first and a second opposed concave guide surfaces removably disposed across the first and the second conveyor means so that the first guide surface diverts cops from the first conveyor means to the second conveyor means and so that the second guide surface diverts cops from the second conveyor means to the first conveyor means.

19. A system as claimed in claim 13, wherein the third conveyor means comprises a single conveyor belt spanning the first and the second bobbin ejecting passages.

20. A system as claimed in claim 19, wherein the second diverting means comprises a member rotatably disposed between the first and the second bobbin ejecting passages, the member being rotatable between a first position wherein the member angularly obstructs the first bobbin ejecting passage so that the member diverts the bobbins from the first to the second bobbin ejecting passage and a second nonobstructing position substantially parallel to the direction of travel of the bobbins in the first bobbin ejecting passage.

* * * * *